US006389148B1

(12) United States Patent
Yoo et al.

(10) Patent No.: US 6,389,148 B1
(45) Date of Patent: May 14, 2002

(54) ELECTRIC-ACOUSTIC TRANSDUCER HAVING MOVING MAGNET AND TRANSDUCING METHOD THEREOF

(75) Inventors: Dong Ok Yoo; Ok Jung Yoo, both of Kyungki-do (KR)

(73) Assignee: Microtech Corporation, Kyungki-Do (KR)

( * ) Notice: Subject to any disclaimer, the term of this patent is extended or adjusted under 35 U.S.C. 154(b) by 0 days.

(21) Appl. No.: 09/554,196

(22) PCT Filed: Nov. 19, 1999

(86) PCT No.: PCT/KR99/00698

§ 371 Date: May 11, 2000

§ 102(e) Date: May 11, 2000

(87) PCT Pub. No.: WO00/32013

PCT Pub. Date: Jun. 2, 2000

(51) Int. Cl.[7] ..... H04R 25/00
(52) U.S. Cl. ..... 381/417; 381/421; 381/423
(58) Field of Search ..... 381/396, 418, 381/419, 420, 423, 421, 162

(56) References Cited

U.S. PATENT DOCUMENTS 4,000,381 A * 12/1976 Plice et al. ..... 381/418

FOREIGN PATENT DOCUMENTS

JP 2-27896 A * 1/1990

* cited by examiner

*Primary Examiner*—Sinh Tran
(74) *Attorney, Agent, or Firm*—Rosenberg, Klein & Lee

(57) ABSTRACT

Disclosed is an electric-acoustic transducer comprising at least one fixed coil adapted to generate alternating magnetic field upon externally receiving an electrical drive signal, a frame having a recessed structure for centrally receiving and supporting the fixed coil, at least one moving permanent magnet disposed over the fixed coil while being spaced from the fixed coil by a desired vertical distance in such a fashion that it is vertically movable, the moving permanent magnet serving to generate non-alternating magnetic field, and a vibrating diaphragm supported by an upper end of the frame at a peripheral portion thereof, the vibrating diaphragm supporting the permanent magnet by a central portion thereof, whereby the vibrating diaphragm vibrates vertically in accordance with an interaction between the alternating magnetic field generated from the fixed coil and the non-alternating magnetic field generated from the permanent magnet.

8 Claims, 14 Drawing Sheets

ELECTRIC-ACOUSTIC TRANSDUCER HAVING MOVING MAGNET AND TRANSDUCING METHOD THEREOF

TECHNICAL FIELD

The present invention relates to an electric-acoustic transducer having a moving magnet structure and transducing method thereof, and more particularly to an improved electric-acoustic transducer and electric-acoustic transducing method in which a driving coil generating an alternating magnetic field in accordance with an audio signal is fixed to a frame, and a permanent magnet generating a non-alternating magnetic field is displaced by the alternating magnetic field to displace a vibrating diaphragm, thereby producing a sound corresponding to the audio signal.

BACKGROUND ART

A micro-speaker is a kind of an electric-acoustic transducer which transduces an electric signal of a variety of electronic appliances, requiring a transmission of a sound, into an audio sound. A conventional micro electric-acoustic transducer, (hereinafter, referred to as "micro-speaker"), usually is classified into an electrodynamic type speaker and an electromagnetic type speaker.

The electrodynamic type speaker is of a structure in which the attraction and repulsion caused due to a reaction of a non-alternating (direct current: DC) magnetic flux generated in a fixed magnetic circuit upon an alternating (alternating current: AC) rotation magnetic flux generated in a moving coil movable in an upward and downward direction vibrate both the vibrating diaphragm and the moving coil upwardly and downwardly to produce a sound. That is, the electrodynamic type speaker is a speaker in which the permanent magnet is fixed and the moving coil is moved, so that a sound is generated.

However, the electrodynamic type speaker has disadvantages that in the case where it is manufactured in a micro form in order to apply to a notebook computer, a mini-cassette tape player, and a mobile communication terminal, etc., it is impossible to reproduce an expansion of the ranges of a low-pitched sound and a high-pitched sound necessary for portable electronic appliances in terms of a structure of a speaker, and a breaking of a coil wire for supplying electric energy to the moving coil vibrating upwardly and downwardly makes it impossible to both receive a high input and secure sufficient space to allow for an upward and downward vibration of the moving coil to receive a high output.

For reference, in a micro-speaker currently on the market, a rated input of a product whose diameter is less than 20 mm is 0.01 (W)~0.1 (W).

In addition, in the case where a speaker is embedded in a main PCB of a set, because a structure allowing the speaker to be automatically embedded in the main PCB with respect to all directions of 360 degrees while allowing the speaker to be electrically connected with the PCB has not been designed yet, automation in operation is not completely performed and a great deal of effort and time is needed when embedding the speaker in the PCB.

Meanwhile, in the electromagnetic type speaker, when the constant attraction of the permanent magnet reacts upon the alternating magnetic flux of alternating current properties generated in the moving coil to adjust a strength of the magnetic field, both the permanent magnet and the coil have been fixed so that a tension of the vibrating diaphragm itself causes a displacement of the vibrating diaphragm, thereby producing a sound.

However, the above electromagnetic type speaker has an inadequate coupling structure in which embedding of the speaker in a set always requires a bonding and soldering process of the speaker to the main PCB of the set. Further, in the electromagnetic type speaker, the vibrating diaphragm cannot freely vibrate upwardly and downwardly, and the upper and lower space necessary for a vibration of the vibrating diaphragm is very narrow, which makes it impossible to reproduce a sound of a broad band and a high input.

There is therefore a need in the art for a micro-speaker that can reproduce a sound of a broad band, receive a high input, and can be automatically embedded in a PCB of a set in all directions of 360 degrees without a soldering process in order to realize a multipurpose mini personal information processing terminal in the near future.

DISCLOSURE OF THE INVENTION

The present invention has been made in view of the above mentioned problems involved in the conventional micro electric-acoustic transducer, i.e., micro-speakers, and an object of the invention is to provide an electric-acoustic transducer and transducing method thereof in which in a state in which a driving coil is fixed to a frame, generation of an alternating magnetic field by an electric driving signal of the outside causes displacement of a permanent magnet, supported by a vibrating diaphragm, generating a non-alternating magnetic field, so that the vibrating diaphragm is also displaced, thereby producing a sound corresponding to the electric signal.

Another object of the invention is to provide an improved micro-speaker which includes a disc-shaped moving magnet in which a magnetic circuit is coupled to a vibrating diaphragm or a moving magnet serving as the vibrating diaphragm, and a fixed coil.

Still another object of the invention is to provide an improved micro-speaker which can receive a broad band, a high input and a high output covering functions for reproducing sounds outputted from various portable electronic appliances and all sounds of a receiver and a micro-speaker, as a single unit of a small size.

Still another object of the invention is to provide an improved micro-speaker in which the above-mentioned functions are implemented and automatic mounting/coupling of the speaker in all directions 360 degrees to a PCB of a set can be performed by simply applying a pressure to the speaker, and which has a structure allowing for automation of a process of manufacture.

Yet another object of the invention is to provide an improved micro-speaker which has a new structure formed of a plurality of moving magnets or a single moving magnet and a plurality of fixed coils, can be automatically embedded on the surface of a PCB of a set in all directions of 360 degrees, and can reproduce a sound of a broad band range, and receive a high input.

In accordance with one aspect, the present invention provides an electric-acoustic transducer comprising: at least one fixed coil adapted to generate an alternating magnetic field upon externally receiving an electrical drive signal; a frame having a recessed structure for centrally receiving and supporting the fixed coil; at least one moving permanent magnet disposed over the fixed coil while being spaced from the fixed coil by a desired vertical distance in such a fashion that it is vertically movable, the moving permanent magnet serving to generate a non-alternating magnetic field; and a vibrating diaphragm supported by an upper end of the frame at a peripheral portion thereof, the vibrating diaphragm supporting the permanent magnet by a central portion thereof; whereby the vibrating diaphragm vibrates vertically in accordance with an interaction between the alternating magnetic field generated from the fixed coil and the non-alternating magnetic field generated from the permanent magnet.

In accordance with another aspect, the electric-acoustic transducer of the present invention further comprises: a printed circuit board buried in a bottom portion of the frame, the printed circuit board having a pair of electrode patterns, to which a pair of coil lines extending from the fixed coil are connected, respectively, so that the printed circuit board serves as a terminal plate, the electrode patterns being arranged at different radial positions with respect to the center of the fixed coil; a pair of electrodes each having one end mounted to an associated one of the electrode patterns and the other end extending downwardly from the printed circuit board while having an elasticity, the drive signal being applied to the electrodes; and snap coupling means extending downwardly from the bottom portion of the frame inside the electrodes, the snap coupling means being coupled, in a snapped fashion, to a coupling hole formed at a main printed circuit board mounted to an appliance, to which the transducer is applied, the main printed circuit board generating the drive signal and having a pair of concentric annular electrode pads arranged at different radial positions with respect to the center of the coupling hole, the radial positions of the annular electrode pads corresponding to the radial positions of the electrodes, respectively.

In accordance with one aspect, the present invention provides an electric-acoustic transducing method comprising the steps of: externally applying an electrical drive signal to a fixed coil fixed to a frame, thereby generating alternating magnetic field varying in accordance with the electrical drive signal; and vertically vibrating a moving permanent magnet adapted to generate non-alternating magnetic field of a desired magnitude and supported to a vibrating diaphragm in such a fashion that it is vertically movable by the vibrating diaphragm, thereby generating sound.

In accordance with the present invention, the electric-acoustic transducer has a sound reproducing capacity of a broad band range (300 Hz ~16 KHz for a product having a diameter of 20 mm) necessary for various portable electronic appliances, a receiver and a micro-speaker, and can receive a high input (a rated input of 3~5 W for a product having a diameter of 20 mm). Further, in the electric-acoustic transducer, automatic mounting of the speaker in all directions 360 degrees to a PCB of a set can be performed while accomplishing complete automation of a process of manufacture without requiring a soldering and bonding process.

BEST MODE FOR CARRYING OUT THE INVENTION

A preferred embodiment of the present invention will be described in detail hereinafter with reference to the accompanying drawings.

Figure 1:
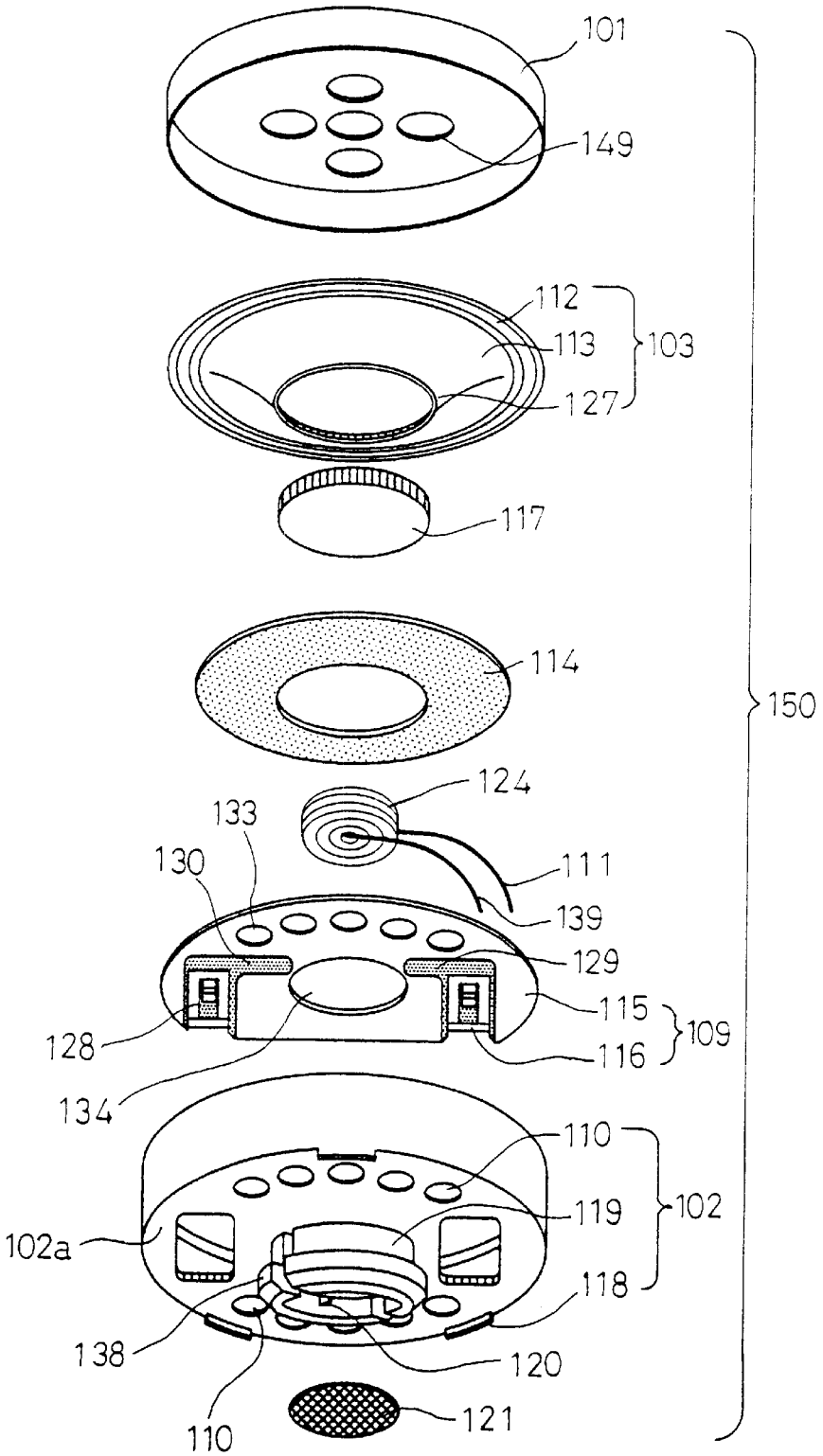
FIG. 1 is an exploded perspective view illustrating a micro-speaker having a moving magnet structure according to a first preferred embodiment of the present invention.
Figure 2:
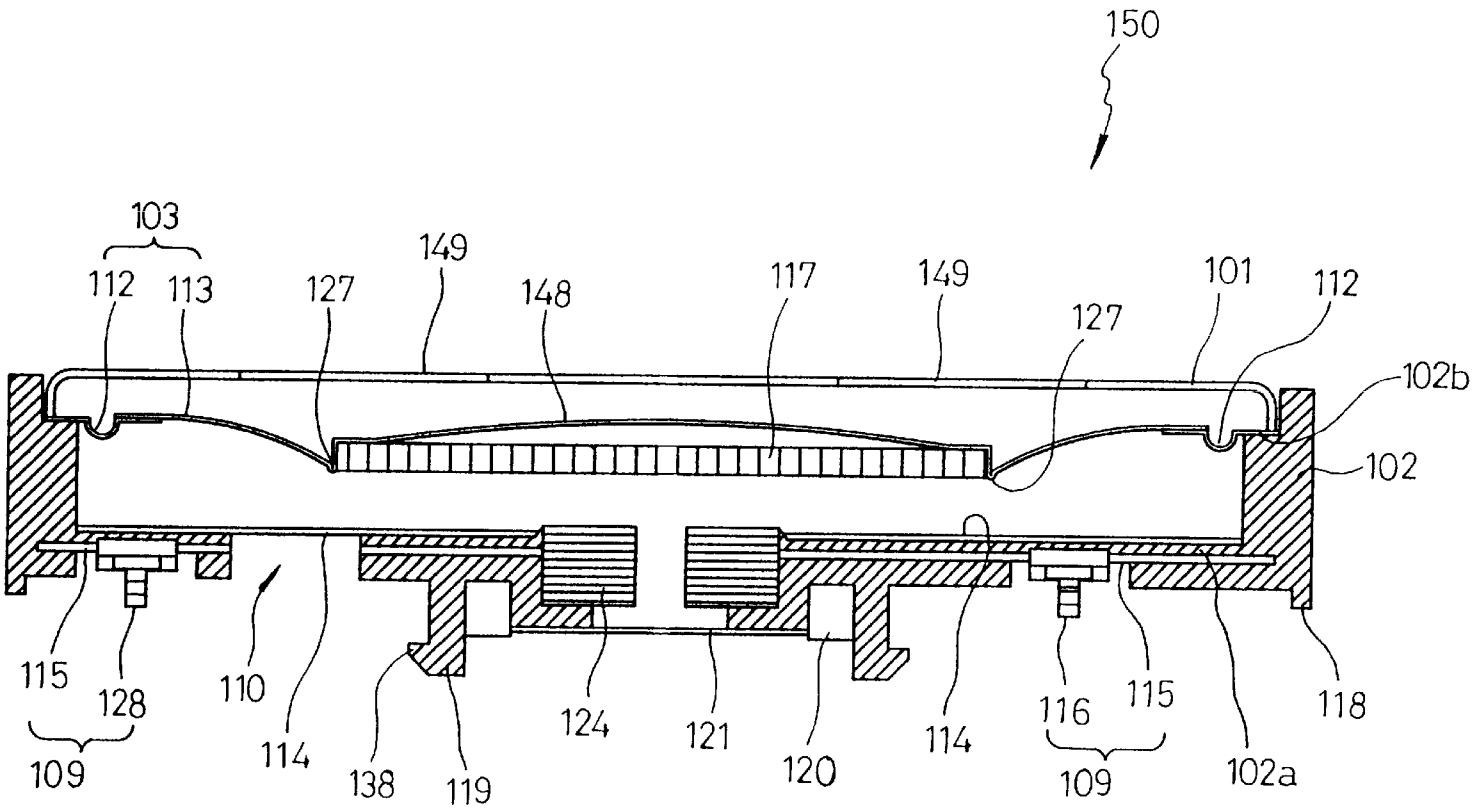
FIG. 2 is a cross-sectional view illustrating a micro-speaker according to a first preferred embodiment of FIG. 1 in a state in which the micro-speaker is assembled.
Figure 3A:
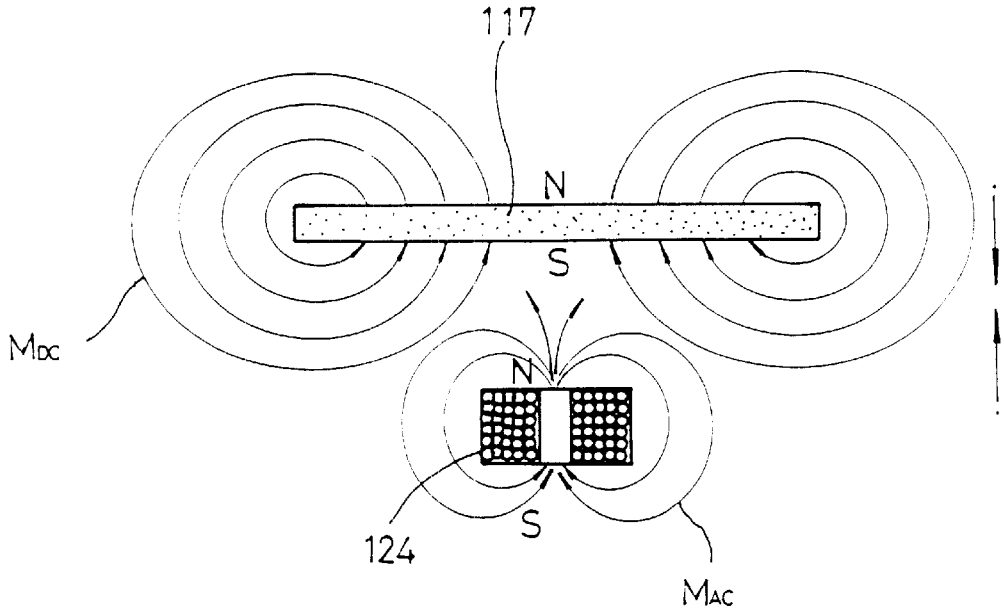
FIGS. 3A and 3B are schematic views illustrating a relationship between a moving magnet and a fixed coil for explaining a voice transducing principle of a speaker according to an embodiment of the present invention.
Figure 3B:
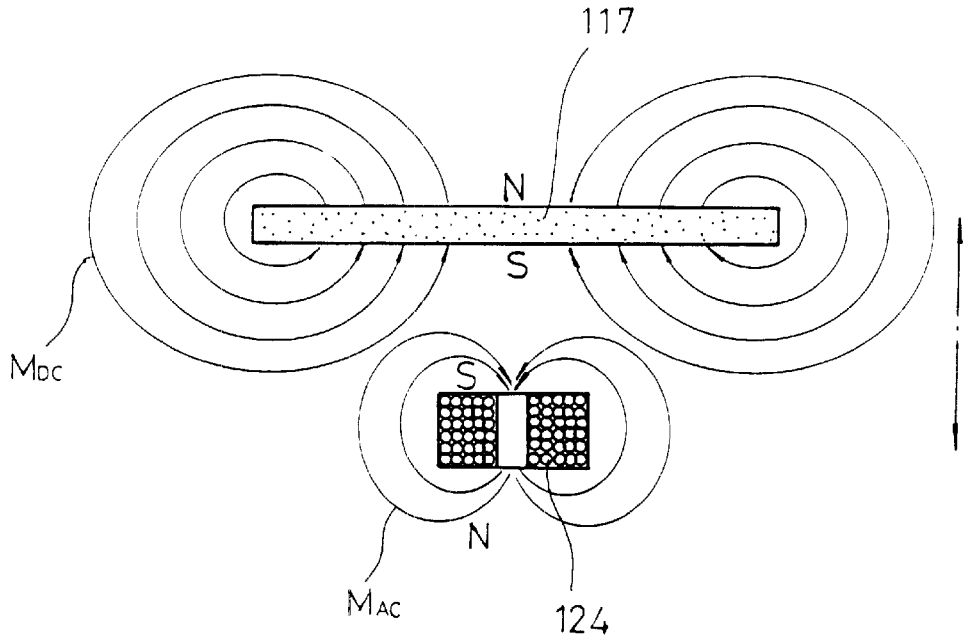
Figure 4:
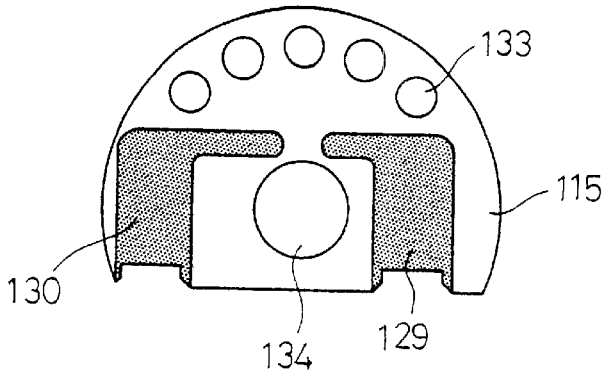
FIG. 4 is a plan view illustrating a terminal plate according to an embodiment of the present invention.

FIG. 1 is an exploded perspective view illustrating a micro speaker having a moving magnet structure according to a first preferred embodiment of the present invention, FIG. 2 is a cross-sectional view illustrating a micro speaker according to a first preferred embodiment of FIG. 1 in a state in which the micro speaker is assembled, and FIGS. 3A and 3B are a schematic view illustrating a relationship between a moving magnet and a fixed coil for explaining a voice transducing principle of a speaker according to an embodiment of the present invention.

Referring to the FIGS. 1 and 2, a micro speaker 150 according to the present invention includes a frame 102 having a recessed cylindrical structure. The frame 102 is provided with a step 102*b* at the inner surface of a vertical wall thereof. The frame 102 is open at the top thereof and has a plurality of uniformly spaced vent holes 110 at the bottom portion thereof. The vent holes 110 serve to provide a smooth vibration of a vibrating diaphragm 103. A coupler 119 is downwardly protruded from the bottom portion of the frame 102 in such a fashion that it is concentrically arranged with the frame 102. The coupler 119 is provided at a lower end thereof with an annular protrusion 138 outwardly protruded from the outer surface of the coupler 119 in a radial direction. Accordingly, the coupler 119 has a hook-shaped tip at its lower end. Support ribs 120 extends inwardly from the inner surface of the coupler 119 in a radial direction.

A terminal plate 109 is mounted to the bottom portion 102*a* of the frame 102. A fixed coil 124 is also mounted ot the bottom portion 102*a* of the frame 102. The terminal plate 109 includes a printed circuit board (PCB) 115, and flexible electrodes 116 and 128 each having a clip spring structure. Each of the flexible electrodes 116 and 128 are mounted to the PCB 115. The fixed coil 124 is centrally arranged with respect to the terminal plate 109 in such a fashion that its upper end is positioned at a level higher than the terminal plate 109 by a desired vertical distance. Both the terminal plate 109 and fixed coil 124 are mounted to the frame 102 in accordance with an insert molding technique so that they are integral together.

Stoppers 118 are downwardly protruded from the peripheral portion of the frame 102 by a desired length while being spaced from one another by an angle of 120° in order to prevent the flexible electrodes 116 and 128 from being damaged when the speaker 150 is coupled to a main PCB 126 included in an electronic appliance to which the speaker 150 is applied.

Preferably, an acoustic impedance control sheet 114 and a dust proof sheet 121 are bonded on the upper surface of the bottom portion 102*a* of the frame 102 and on the inner lower surface of the coupler 119, respectively.

A protector 101 having a plurality of sound emitting holes 149 is fixed on the step 102*b* of the frame 102 at a peripheral portion thereof in such a manner that it is positioned at the same level as the upper end of the frame 102.

Also, a vibrating diaphragm 103 is disposed in a space defined between the bottom portion 102*a* of the frame 102 and the protector 101. A moving magnet 117 is coupled to the vibrating diaphragm 103.

Figure 9:
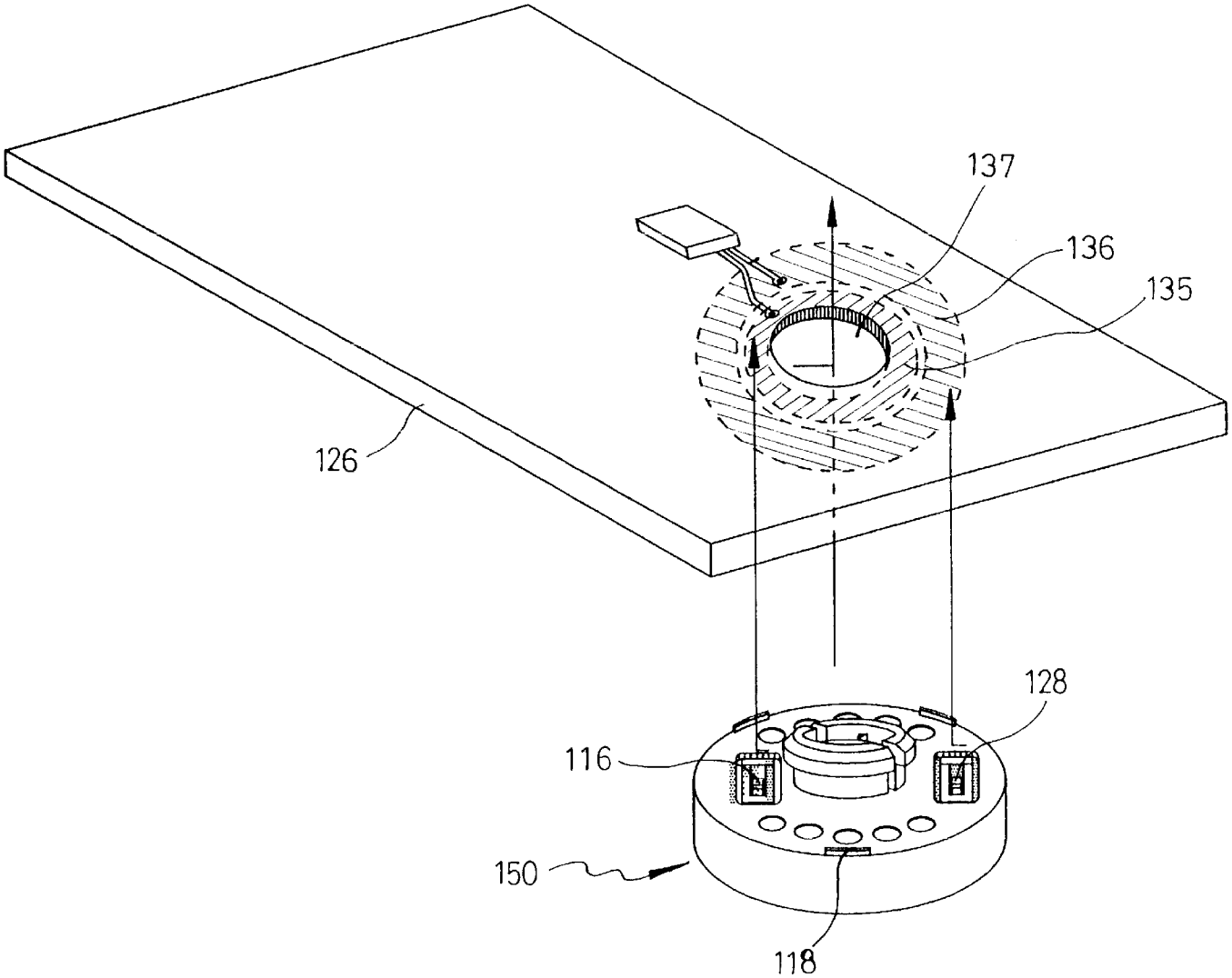
FIG. 9 is a perspective view illustrating an assembling process in which a finished product of a speaker of a surface mounting type will be assembled to a PCB of a set according to an embodiment of the present invention.
Figure 10:
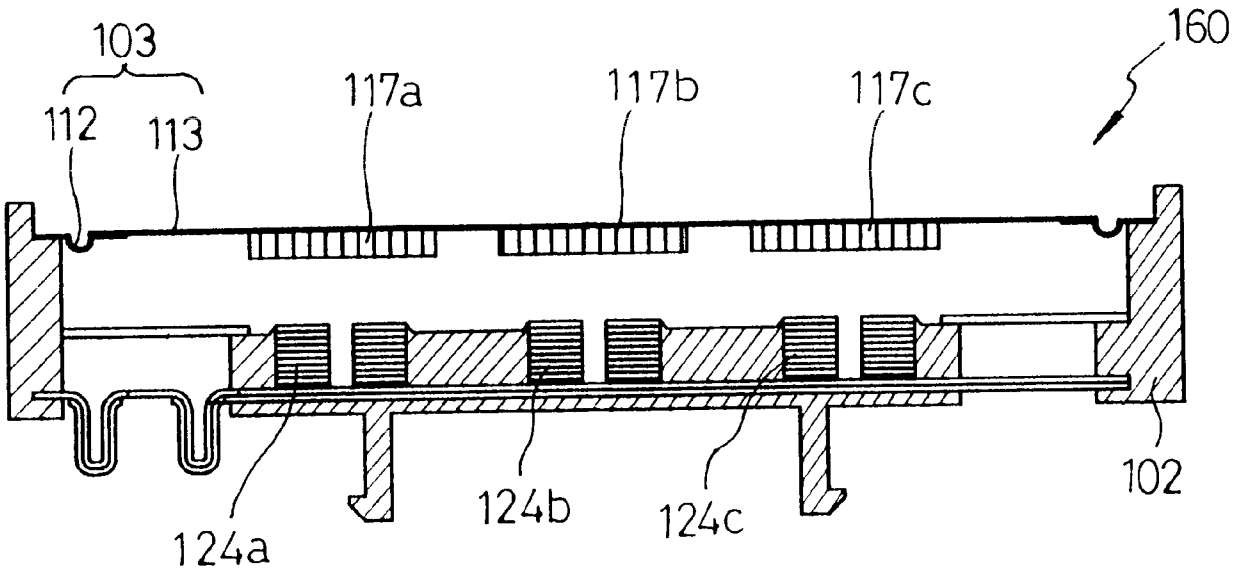
FIG. 10 is a cross-sectional view illustrating a micro-speaker having a plurality of moving magnets according to a second embodiment of the present invention.

To describe this in more detail, in the first embodiment of the present invention, the circular coupler 119, which extends downwardly from the bottom portion 102*a* of the frame 102, may have slits so that it is split into two or more portions arranged a circular shape. The protrusion 139 formed at the lower end of the coupler 119 may have a semi-circular shape or a trapezoidal shape. Such configurations of the coupler 119 and protrusion 138 provide a structure capable of allowing an easy and reliable coupling of the speaker 150 to the main PCB 126. That is, the coupler 119 can be easily elastically fitted in a coupling hole 137 formed at the main PCB 126, as shown in FIG. 9. In this case, the protrusion 138 serves to maintain the fitted state of the coupler 119 in the coupling hole 137.

In addition, the PCB 115, which is buried in the bottom portion 102*a* of the frame 102 in accordance with an insert molding method has a pair of thin copper patterns 129 and 130 respectively formed on the upper surface of the PCB 115 at different radial positions radially spaced from the center of a coil hole 134. The coil hole 134 is centrally formed through the PCB 115. A plurality of uniformly spaced vent holes 133 are formed through the PCB 115 outside the thin copper patterns 129 and 130.

Figure 5A:
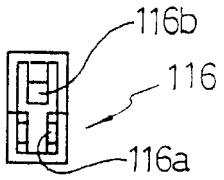
FIGS. 5A and 5B are a plan view and a side view illustrating a clip spring electrode according to an embodiment of the present invention.
Figure 5B:
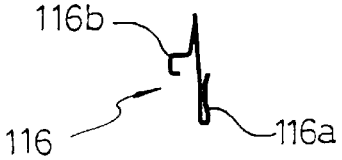
Figure 6A:
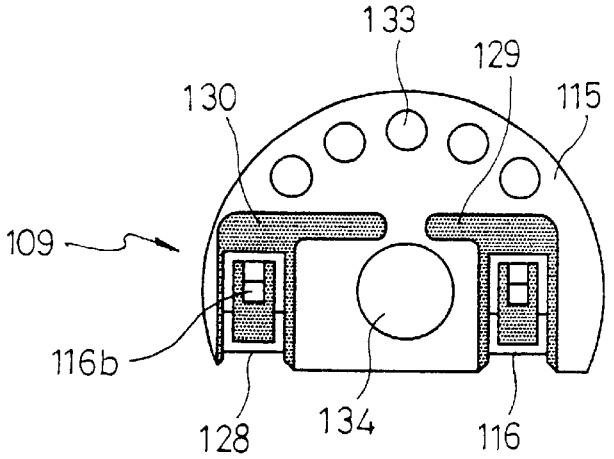
FIGS. 6A to 6C are a plan view, a side view and a rear elevation view illustrating a state in which a clip spring electrode is coupled to a terminal plate according to a first embodiment of the present invention.
Figure 6B:
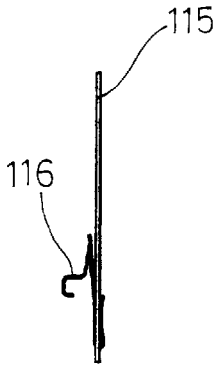
Figure 6C:
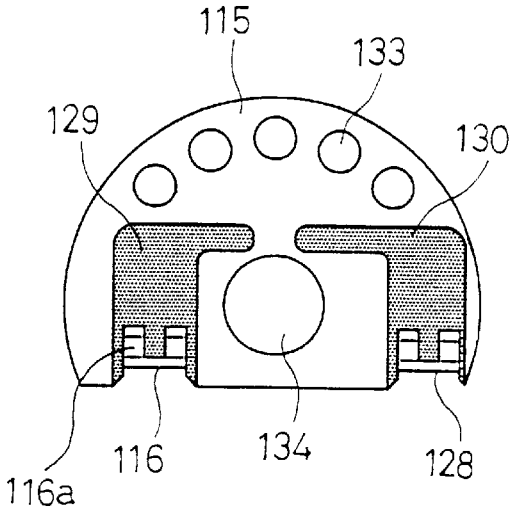

The flexible conductive electrodes 116 and 128 are mounted to the thin copper patterns 129 and 130 of the PCB 115, respectively, in order to allow the speaker 150 to receive a drive signal outputted from the main PCB 126. Each of the flexible conductive electrodes 116 and 128 has a clip spring structure including a clip portion 116*a* and an elastic electrode portion 116*b* integrally formed together, as shown in FIGS. 5A and 5B.

The fixed coil 124 is coupled to the coil hole 134, and coil wires 111 and 139 extending from the fixed coil 124 are coupled to the thin copper patterns 129 and 130, respectively. As mentioned above, this fixed coil 124 is mounted to the frame 102 along with the terminal plate 109 in accordance with an insert molding method. The fixed coil 124 may be a bobbinless coil or a coil wound using a bobbin.

Furthermore, the terminal plate 109 may have a clip spring structure, employing various conductive metal materials, in which the electrodes 116 and 128 are coupled to a hard board PCB 115 as shown in FIGS. 4 to 6C, or a circular rod structure.

Figure 7A:
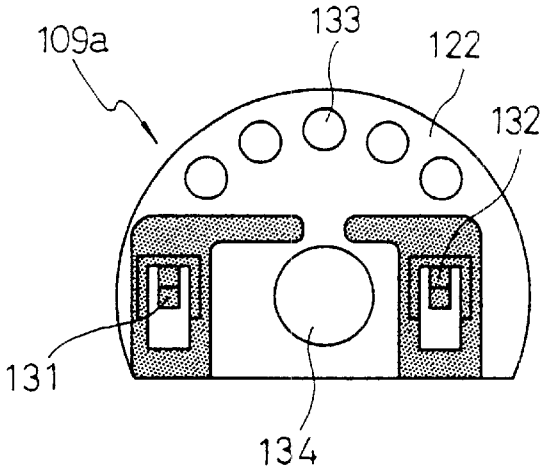
FIGS. 7A to 7C are a plan view, a side view and a rear elevation view illustrating a state in which a clip spring electrode is integrally formed with a flexible terminal plate according to a second embodiment of the present invention.
Figure 7B:
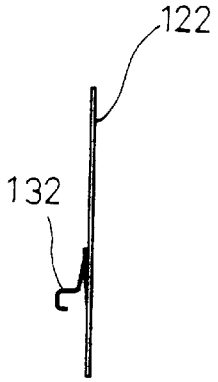
Figure 8:
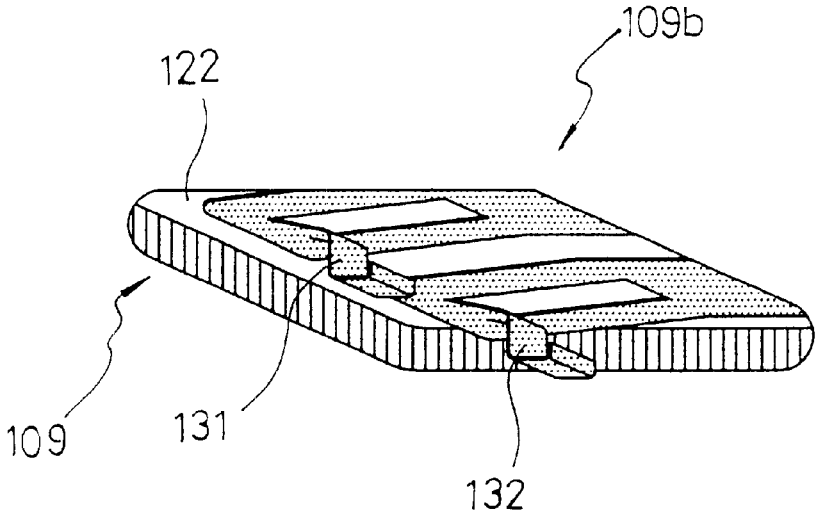
FIG. 8 is a perspective view illustrating a state in which an elastic spring electrode is integrally formed with a terminal plate according to a modification of a second embodiment of the present invention.

Also, the terminal plates 109*a* and 109*b* are integrally formed in such a fashion that the electrodes 131 and 132 are pressed on the PCB 122 by using a flexible printed circuit board (PCB) 122 as shown in FIGS. 7A to 7B and FIG. 8. The PCB 122 of the terminal plate 109*a* has a coil hole 134 and five vent holes 133 formed thereon like in a case of the PCB 115, and a through hole 135 formed in a portion surrounding the electrodes 131 and 132 thereof.

A body 113 and center cap 148 of the vibrating diaphragm 103 applicable to the present invention may be formed of a cone type structure (see first embodiment), a flat type structure (see second embodiment) and a dome type structure, and their usable material may include a polyethylene(PE), a PET, a poly carbonate (PC), a polyethyleneimide (PEI), a polyimide (PI), a capton, or metal materials of reverse-magnetism or anti-magnetism series, i.e., a titanium (Ti), an aluminium (Al), a duralumin, a stainless steel, a brass and a phospor branze.

An cross-section of edge 112 of the body 112 of the vibrating diaphragm 103 may be a up roll type edge (see first embodiment), a down roll type edge (see second embodiment), a flat type edge, and a wave type edge. Also, the edge 112 may be of a gasket integrated type edge, and its materials may be silicon, resin of polymeric series, fiber and rubber, etc.

In this case, the edge 113 of the body 112 of the vibrating diaphragm 103 may be formed by manufacturing it separately like in the above example, and its appearance may be a circular shape, an ellipse shape, a rectangular shape or a regular square shape.

In the first embodiment having the above structure, because the fixed coil 124 forming an alternating rotation magnetic field is fixed integrally to the frame 102 as shown in FIG. 2, it cannot vibrate mechanically. Therefore, the fixed coil 124 forms a non-alternating (direct current) magnetic field and the moving magnet 117 is in movement in accordance with an electric driving signal received from the outside.

Meanwhile, the magnetic circuit of the first embodiment is constructed of a single moving magnet 117 and a single fixed coil 124, but the magnetic circuit of the tenth embodiment may be constructed of a combined structure of a plurality of fixed coils 124*a* to 125*c* and a plurality of non-alternating moving magnets 117*a* to 117*c* corresponding to the fixed coils in order to increase an acceptable input and reinforce a non-alternating magnetic field corresponding to the acceptable input. Also, an appearance of the edge 112 of the second embodiment may be a circular shape or a quadrangular shape.

A modified magnetic circuit of the present invention is also constructed of a disc type moving magnet so that the disc type moving magnet itself can be used as a body 113 of the vibrating diaphragm 103.

Furthermore, the magnetic circuit of the present invention is constructed of a plurality of fixed coils and a single disc type moving magnet like in a case of the modified example, but may be constructed of a single moving magnet while being formed integrally with the body 113.

An modified example of the second embodiment, if all have an identical size, increases the acceptable input, and provides a structure suitable for reinforcement of a non-alternating magnetic field corresponding to the increase of the acceptable input.

Figure 11:
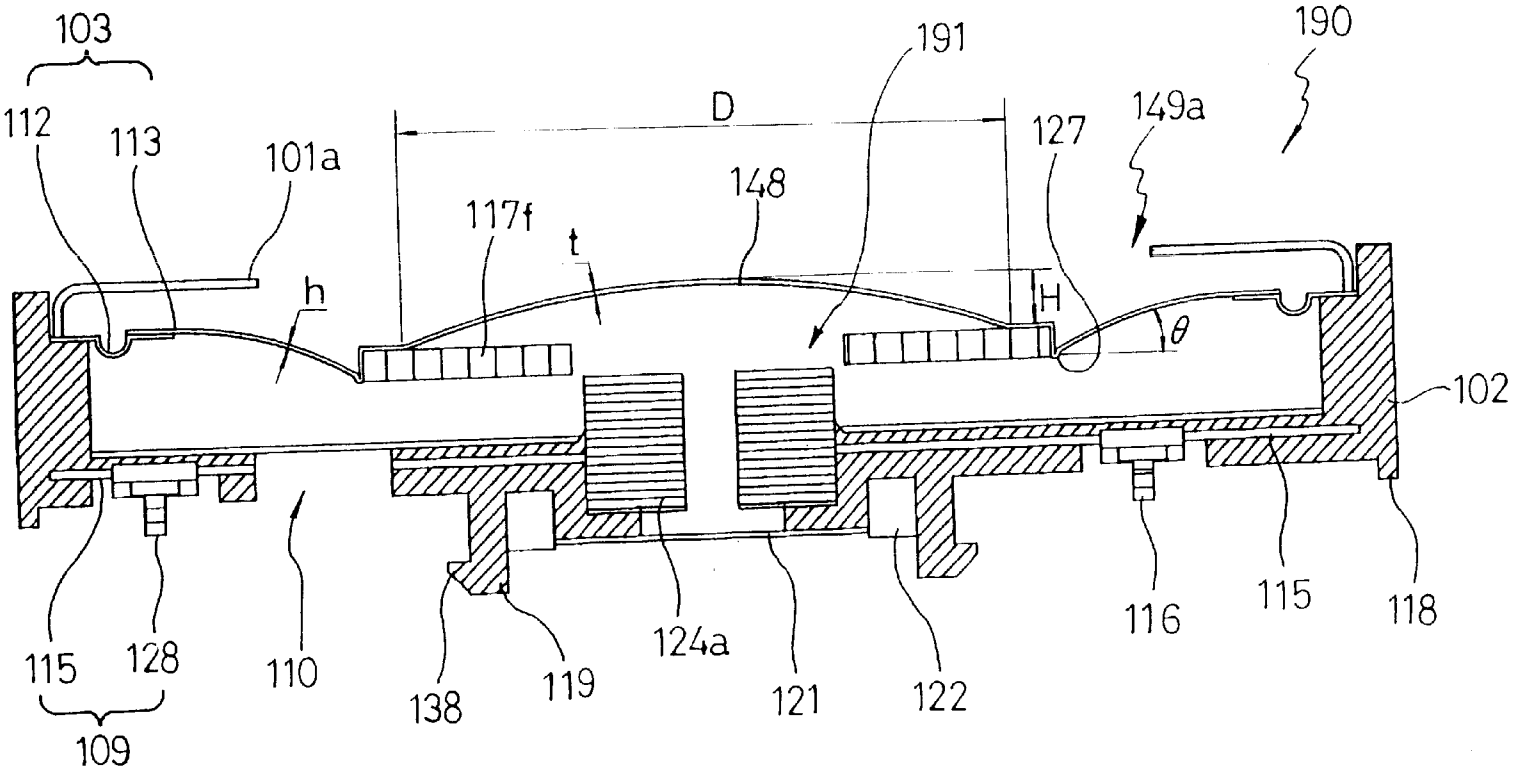
FIG. 11 is a cross-sectional view illustrating a micro-speaker employing a moving magnet having a passage hole according to a third embodiment of the present invention.

In addition, the micro-speaker of the present invention may includes a structure in which a circular or a quadrangular-shaped hole greater than an outer diameter of the fixed coil 124*a* is formed in the middle portion of a moving magnet 117*f* like in a case of the third embodiment (190) as shown in FIG. 11

In the micro-speaker according to the third embodiment, a sound emitting hole 149*a* is formed in the central portion of the protector 101*a,* and a fixed coil 124*a* has a structure in which a height of the top portion thereof is protruded from a level of an acoustic impedance control sheet unlike in a case of the micro-speakers 150 and 160 of the first and second embodiments. The aim for this is to allow the moving magnet 117*f* to be positioned closer to the fixed coil 124*a* when the moving magnet 117*f* having a passage hole 191 formed at a central portion thereof vibrates upwardly and downwardly.

The micro-speaker 190 of the third embodiment is a transducer having a structure in which the passage hole 191 prevents the moving magnet 117*f* from contacting with the fixed coil 124*a* while allowing an enough vibration of the moving magnet within a limited space to be performed when the moving magnet 117*f* vibrates upwardly and downwardly. The micro-speaker 190 is advantageous to a case in which a high output is required in a limited micro size.

Figure 12:
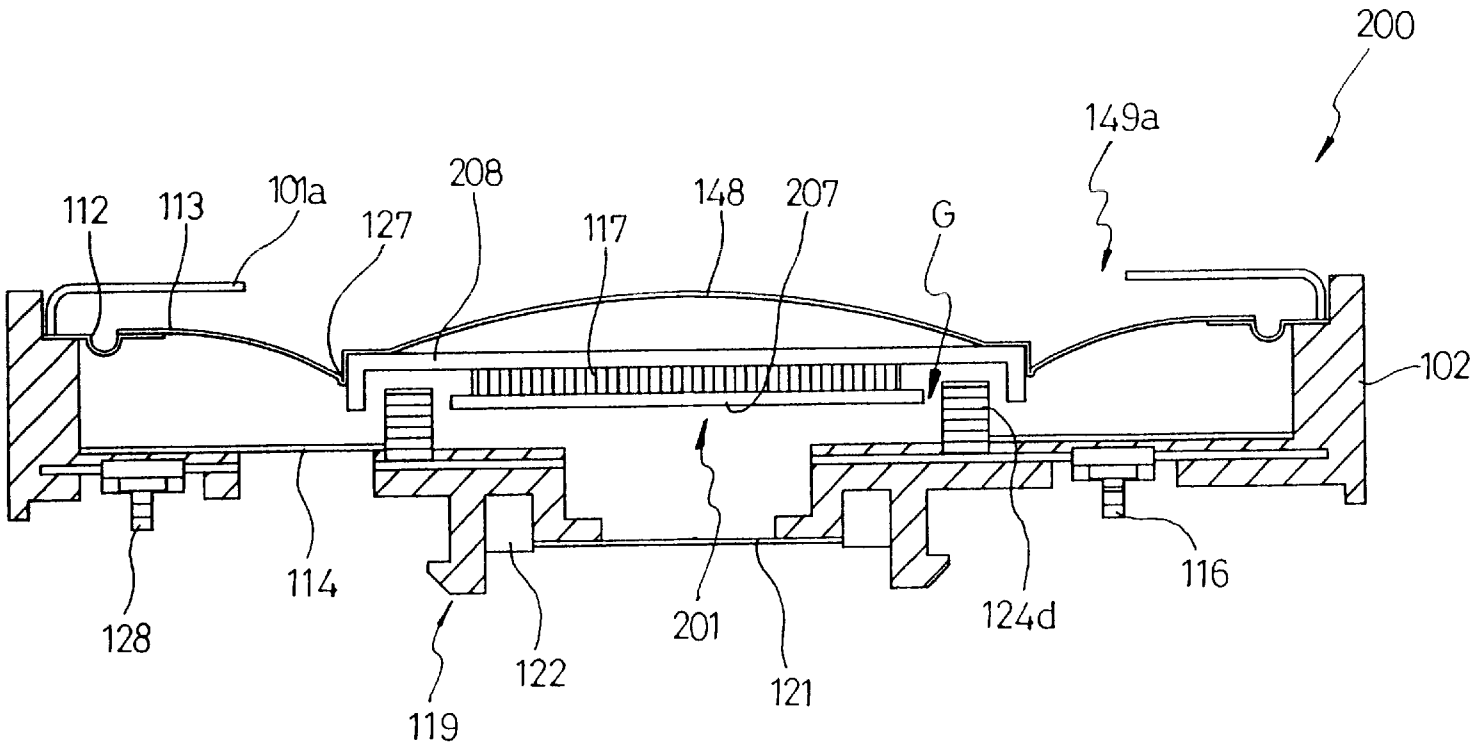
FIG. 12 is a cross-sectional view illustrating a micro-speaker employing a moving magnet having a magnet concentration configuration according to a fourth embodiment of the present invention.

FIG. 12 illustrates a fourth embodiment of the present invention, in which magnetic flux of a moving magnet is concentrated in an air gap thereby to improve transducing efficiency and bass resonance frequency $f_0$ is further reduced thereby to extend a reproduced octave band.

In a speaker 200 according to the fourth embodiment of the present invention, an upper surface of a disc-shaped moving magnet 117 is mounted to a cylindrical yoke 208 which has an inverted "U"-shaped cross-section, and a disc-shaped plate 207 having a diameter which is larger than that of the moving magnet 117, is mounted to a lower surface of the moving magnet 117. The yoke 208 which constitutes the magnetic circuit 201, is fastened to a neck 127 of a vibrating diaphragm 103.

Further, similarly to the third embodiment, in the fourth embodiment of the present invention, a sound emitting hole 149*a* is formed at a central portion of a protector 101*a,* and, when being mounted, a fixed coil 124*d* protrudes such that its height is different from those in the cases of the first through third embodiments. The fixed coil 124*d* is structured such that it has a diameter which is larger than those of the first through third embodiments.

While it is the norm that transducing efficiency is decreased as weight of a moving magnet is increased, in the above-mentioned structure of a magnetic circuit 201, because magnetic flux is concentrated in an air gap G between the yoke 208 and the plate 207, transducing efficiency is rather increased.

In the fourth embodiment, at an initial state, the moving magnet 117 is established such that the fixed coil 124*d* is positioned in the air gap G between the yoke 208 and the plate 207. The moving magnet 117 vibrates up and down when a driving signal (for example, a sound signal) is applied to the fixed coil 124*d*.

Since other components of the fourth embodiment except the magnetic circuit 201 have the same structures as those of the first through third embodiments, further explanations thereof will be omitted.

The magnetic circuit 201 of the fourth embodiment can have other structures which are different from the above-mentioned structure. For example, in the magnetic circuit 201, in order to increase coupling force of the neck 127, a vibration diaphragm seating guide to which the neck 127 of the vibrating diaphragm 103 is coupled, can be installed around a circumferential outer surface of an upper part of the yoke 208. Also, the plate can be omitted from the magnetic circuit 201, and instead, a lower end of a skirt of the yoke 208 can be bent toward the moving magnet 117 such that magnetic flux emitted from the lower end of the skirt of the yoke 208 is concentrated in the moving magnet 117 through the air gap G. Furthermore, in the magnetic circuit 201, the lower end of the skirt of the yoke 208 can be bent toward the moving magnet 117 such that magnetic flux emitted from the lower end of the skirt of the yoke 208 is concentrated in the moving magnet 117 through the air gap G. By this construction, high transducing efficiency is obtained due to the fact that high density of magnetic flux is accomplished in the air gap G.

Figure 13:
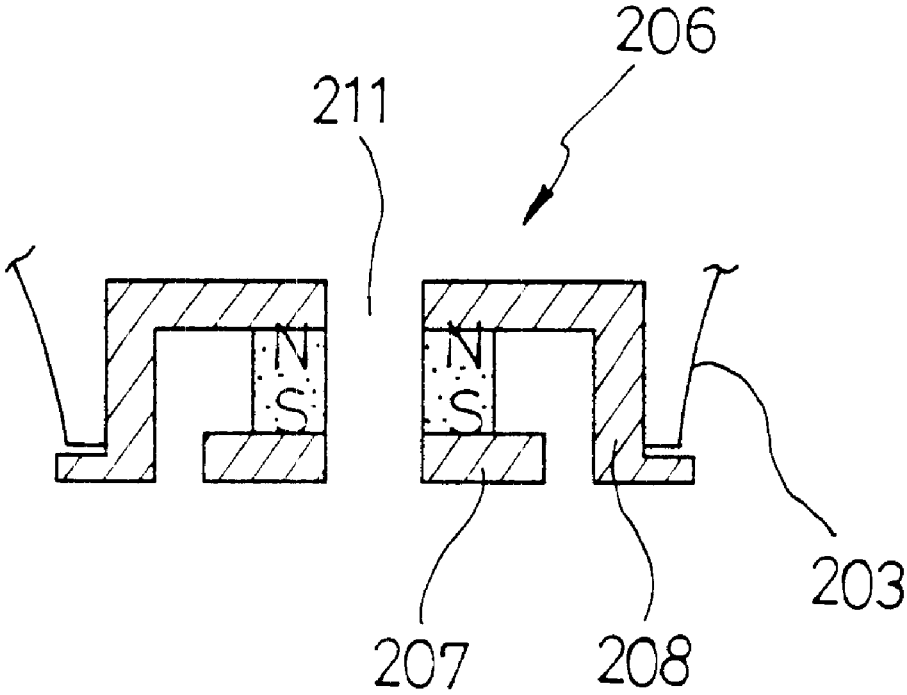
FIG. 13 is a cross-sectional view illustrating an applicable modification of a magnetic circuit according to a fourth embodiment of the present invention.

A magnetic circuit 206 shown in FIG. 13 illustrates another modification in which an air vent 211 is formed in central portions of the yoke 208, moving magnet 117 and plate 207. In the illustrated magnetic circuit 206, heat inside the speaker can be discharged through the air vent 211, and mechanical resistance and acoustic resistance can be adjusted thereby to be used in regulating a Q factor (an inverse of braking force) at bass resonance and bass resonance frequency $f_0$.

In the fourth embodiment having the aforementioned magnetic circuits 201 and 206, as will be described later, equivalent mass of a vibrating system is increased when compared to those of the first through third embodiments, whereby bass resonance frequency $f_0$ is reduced and, as a result of this, a reproduced octave band is extended.

In the case that all the speakers according to the first through fourth embodiments of the present invention are assembled to end products, the end products have structures of electrodes 116 and 128 which can be automatically connected, without using a soldering technique, to a circular coupler 119 in all radial directions, that is, through 360°. The electrodes 116 and 128 are set such that they are positioned at different distances from a center of a coil hole 134.

In this case, a coupling hole 137 to which the circular coupler 119 is coupled, is formed in a main PCB 126 of an electronic appliance. A first circular electrode pattern 135 is formed outward of the coupling hole 137 such that it is positioned at the same distance from a center of the coupling hole 137 as the first electrode 116, and a second circular electrode pattern 136 is formed outward of the first circular electrode pattern 135 such that it is positioned at the same distance from the center of the coupling hole 137 as the second electrode 128.

Accordingly, when mounting the small-sized speaker, by pressing the circular coupler 119 after positioning the circular coupler 119 of the small-sized speaker to the coupling hole 137 of the main PCB 126, the two circular electrode patterns 135 and 136 are electrically connected in an automatic and elastic manner to the two electrodes 116 and 128 of the small-sized speaker, respectively.

Now, the operation principle and functions of the electric-acoustic transducer according to the illustrated embodiment will be described in detail.

Principle of Electric-Acoustic Transduction and Wide Band Configuration

When a drive signal having, for example, a square waveform, is applied from the main PCB 126 to the fixed coil 124 via the terminal plate 109, the fixed coil 124 generates an alternating current magnetic field $M_{AC}$ rotating in an outward radial direction from the center of the fixed coil 124 (FIG. 3*a*) or in a reverse direction (FIG. 3*b*).

The alternating magnetic field $M_{AC}$ reacts with a direct current magnetic field $M_{DC}$ generated in a constant direction from the moving magnet 117. As a result, a repulsing force is effected between the moving magnet 117 and fixed coil 124 when the relative magnetic fields have the same effecting direction (FIG. 3*b*). On the other hand, when the relative magnetic fields have opposite effecting directions, respectively, an attracting force is effected between the moving magnet 117 and fixed coil 124 (FIG. 3*a*).

Since the fixed coil 124 is fixed in a state fitted in a recess defined in the frame 102, all electromagnetic forces serving to cause a variation in pressure resulting in a generation of sound are concentrated on the moving magnet 117 coupled to the vibrating diaphragm 103 configured to be vertically movable.

Accordingly, the moving magnet 117 vibrates vertically by virtue of the attracting and repulsing electromagnetic forces. In accordance with the vibration of the moving magnet 117, the vibrating diaphragm 103 also vibrates. As a result, compressional waves of air are produced, thereby generating sound.

In this case, the generated acoustic output exhibits an increased efficiency when the distance between the fixed coil 124 and moving magnet 117 is reduced, when the magnetic forces respectively generated from the fixed coil 124 and moving magnet 117 are increased, when the effective area of the vibrating diaphragm 103 (the area between the intermediate portions of the edge 112 arranged at opposite sides of the edge 112) is increased, or when the weight of the entire vibrating system is reduced.

The edge 112 and body 113 of the vibrating diaphragm 103 should be made of a non-magnetic or diamagnetic material.

In association with the speaker of the present invention adapted to emit sound corresponding to an input electrical signal in accordance with the above mentioned principle, it is preferred for the vibrating diaphragm 103 to be configured using separate elements, that is, the edge 112 made of a non-magnetic material exhibiting a compliance and the body 112 made of a light and hard material.

The edge 112, which has functions for absorbing vibrations of the vibrating diaphragm 103 while limiting those vibrations to a desired level, exhibits a high compliance, the speaker can operate in a resonance frequency range expanded to a lower bass band. The offset angle θ (FIG. 11) and elastic modulus (Young's modulus) E of the neck 127 loud resonance frequency band of the speaker is also expanded by adjusting the offset angle θ (FIG. 11) and elastic modulus (Young's modulus) E of the neck 127 where the body 113 of the vibration diaphragm 103 is mounted to the moving magnet 117. Thus, the speaker of the present invention can achieve a substantial expansion in reproduced octave band as follows.

Generally, the bass resonance frequency fo obtained by virtue of a compliance of the edge 112 can be expressed by the following Expression 1:

$$f_0 = \frac{1}{2\pi}\sqrt{\frac{so}{mo}} \qquad \text{[Expression 1]}$$

In Expression 1, "so" represents stiffness which is an inverse of the compliance of the edge 112, "mo" represents the equivalent mass of the vibrating system expressed by the sum of the weight of the moving magnet 117, half the weight of the edge 112, the weight of the body 113, and an additional mass resulting from a reaction of air ($8/3\times1.23\times a^3$ (Kg)),(herein, "a" represents a radius of a vibrating diaphragm). A reduced value of stiffness corresponds to an increase in compliance.

Where the offset angle of the neck 127 of the body 113 is θ, and the elastic modulus (Young's modulus) E of the neck 127 is E, the loud resonance frequency band of the speaker, fh, is generally expressed by the following Expression 2 in association with the neck of the body:

$$fh = \frac{1}{2\pi}\sqrt{\left(\frac{1}{mm}+\frac{1}{mc}\right)\cdot\pi\cdot E\cdot h\frac{\cos\theta}{\sin\theta}} \quad \text{(Hz)} \qquad \text{[Expression 2]}$$

where, "h" represents the thickness of the body 113 (mm), "E" Young's modulus of the body 112 ($N/M^2$), "θ" the offset angle (°), "mm" the weight of the moving magnet, and "mc" half the total weight of the body and edge, respectively.

The loud resonance frequency fh depends on the shape of the cap. Where the cap is made of aluminum, the loud resonance frequency fh can be expressed by the following Expression 3. On the other hand, where the cap is made of a polymer such as PE or PEI, the loud resonance frequency fh can be expressed by the following Expression 4.

$$fh = 0.38\sqrt{1+\frac{0.52mc}{mm}}\cdot\frac{H}{D^2}\cdot\sqrt{\frac{E}{\rho}}\ (1+43.9\times10^2 t) \qquad \text{[Expression 3]}$$

$$fh = 8.26\sqrt{1+\frac{0.52mc}{mm}}\cdot\frac{H}{D^2}\cdot\sqrt{\frac{E}{\rho}}\ (1+43.9\times10^2 t) \qquad \text{[Expression 4]}$$

In Expressions 3 and 4, "H" represents the height (mm) of the cap at the central portion of the cap, "D" the outer diameter of the cap, "t" the thickness of the cap material, "ρ" the density of the cap material ($Kg/m^3$), "E" Young's modulus of the cap ($N/m^2$)

Referring to Expressions 1 to 4, it can be found that the speaker of the present invention exhibits a low bass resonance frequency $f_0$ and a high loud resonance frequency fh by virtue of the weight of the moving magnet 117, as compared to conventional electrodynamic type speakers. Accordingly, it is possible to achieve an expanded range of bass and treble in accordance with the present invention.

Figure 14:
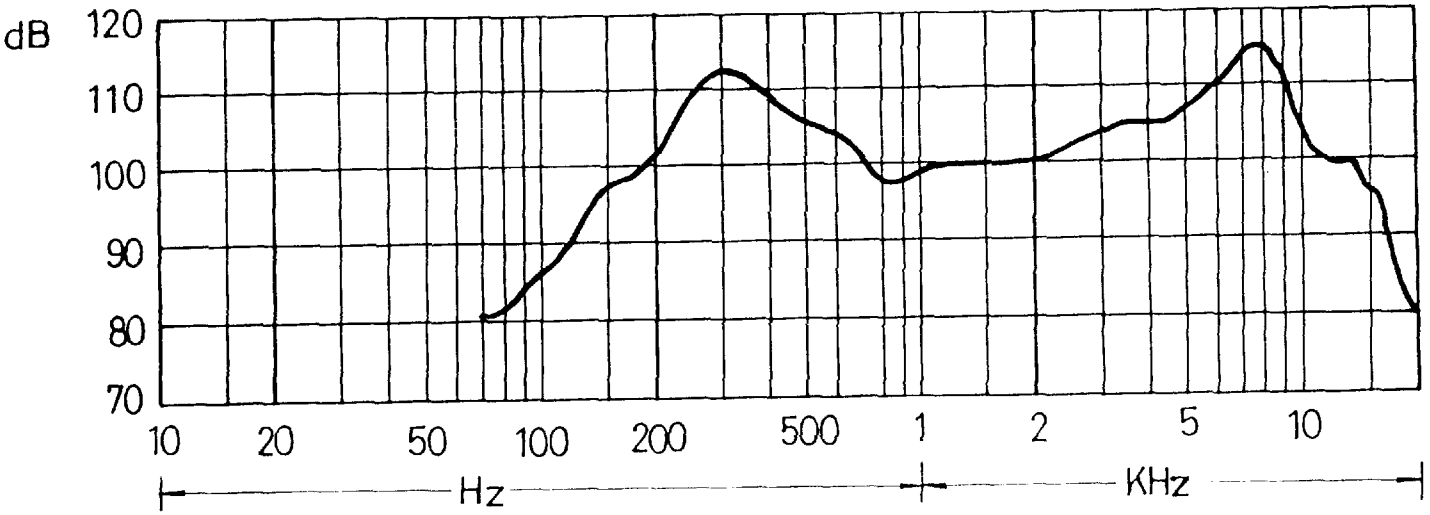
FIG. 14 is a characteristic graph depicting results obtained after measuring the frequency characteristics of the micro-speaker in a free field according to the present invention.

After a measurement of frequency characteristics in a free field for a speaker unit according to the present invention under the condition in which the speaker unit has a size of 20 mm and a height of 3 mm, and electric power of 3 W is applied to the speaker unit in a free field, the speaker unit exhibited a bass resonance frequency $f_0$ of 285 Hz and a treble resonance frequency fh of 15 KHz, as shown in FIG. 14.

Accordingly, it can be found that the speaker of the present invention exhibits frequency characteristics of a wide band, as compared to conventional micro-speakers. Furthermore, the speaker of the present invention can be used for buzzers without any problems because it exhibits gains of 99 dB and 100 dB at frequencies of 1 KHz and 2 KHz, respectively. In conventional buzzers, a gain of about 75 dB is obtained.

Figure 15A:
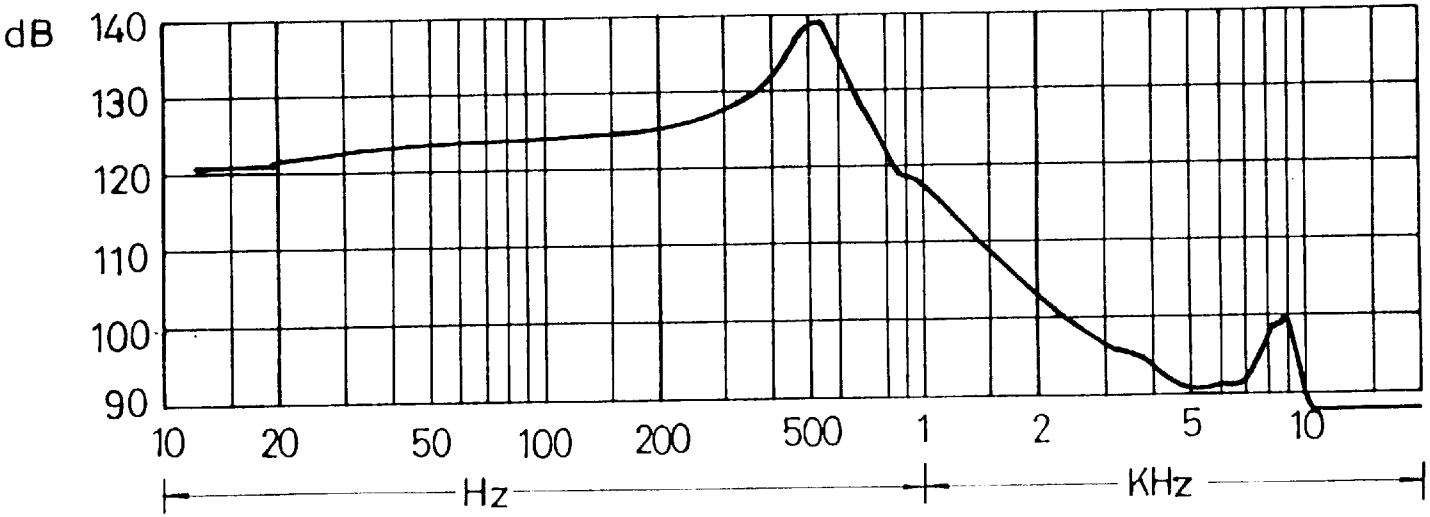
FIGS. 15A and 15B are characteristic graphs depicting results obtained after measuring the frequency characteristics of the product according to the present invention using an IEC 318 artificial ear, in the case in which all the vent holes are opened and in the case in which a sound impedance control sheet is mounted, respectively.
Figure 15B:
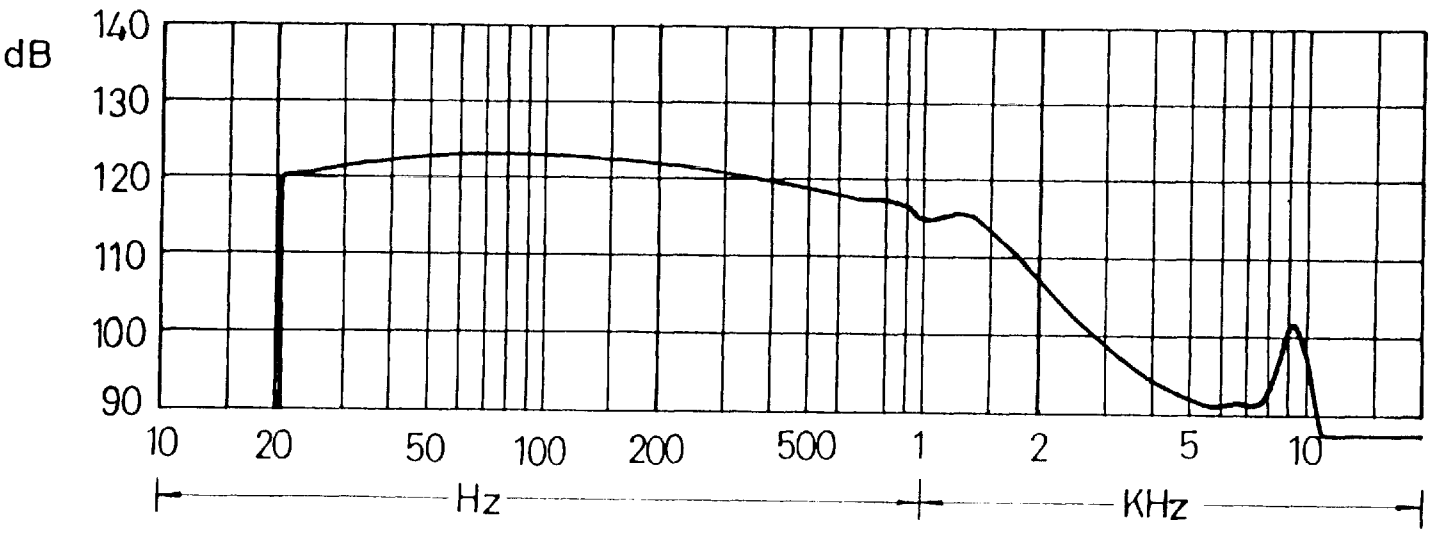

FIGS. 15A and 15B are characteristic graphs depicting results obtained after measuring the frequency characteristics of the product according to the present invention using an IEC 318 artificial ear, respectively. FIG. 15A is a graph depicting results of frequency characteristics measured for the micro-speaker according to the present invention using an IEC 318 artificial ear in a state in which all the vent holes are opened, and FIG. 15B is a graph depicting results of frequency characteristics measured for the micro-speaker according to the present invention using an IEC 318 artificial ear in a state in which a sound impedance control sheet is mounted. As shown in FIGS. 15*a* and 15*b,* it can be seen that results of frequency characteristics measured for the micro-speaker in a state in which all the vent holes are opened, are nearly similar to those measured for a dedicated receiver, and results of frequency characteristics measured for the micro-speaker in a state in which a sound impedance control sheet is mounted, exhibit a low acoustic impedance typed characteristics having an elliptical slope in frequency band range of 20 Hz~1 KHz, thereby showing excellent frequency characteristics.

Accordingly, it can be found that the micro-speaker of the present invention exhibits all frequency characteristics necessary for a micro-speaker, a receiver and a buzzer while having a high acceptable input and a high output by the frequency characteristics of FIG. 14, FIGS. 15*a* and 15*b*.

Prevention of Breaking of Coil and High Input Receiving Configuration

Since conventional electrodynamic type speakers are configured such that a coil vibrates directly to produce a sound, i.e., a coil wire connected to a terminal plate along a body of a vibrating diaphragm from a coil is moved along with a displacement of the vibrating diaphragm, it cannot receive a high input due to a breaking of the coil wire for supplying an electric signal to the coil.

On the other hand, in the micro-speaker of the present invention, a coil 124 and coil wires 111 and 139, when being mounted to a terminal plate 109, are inserted into and securely fastened to a frame 102 in an insert molding method such that the coil wires 111 and 139 withdrawn from the coil 124 are fixed to thin copper patterns 129 and 130 of the terminal plate 109 positioned at a closer distance therefrom. As a result, when the micro-speaker is operated, the coil and frame are maintained in a fixed state.

Accordingly, since the micro-speaker of the present invention is configured such that the coil 124 is fixed, and a moving magnet 117 vibrates without a signal being needed, there is no possibility of breaking of the coil wire and it is possible to receive a high input of a rated input power of 3 W~5 W in even a small-sized speaker having a diameter of 20 mm or so.

Automatic Mount and Automatic Electrode Connection Configuration

The present invention provides an automatic mount and automatic electrode connection functions besides the above-mentioned wide band reproducing and high input receiving functions.

In order to realize this, the micro-speaker of the present invention employs a terminal plate 109 including a flexible electrode 116 and 128 having a clip spring structure serving to receive an electric signal, and a PCB 115 on which thin copper patterns 129 and 130 are positioned at a different distance from a center of the coil hole 134, respectively.

Figure 7C:
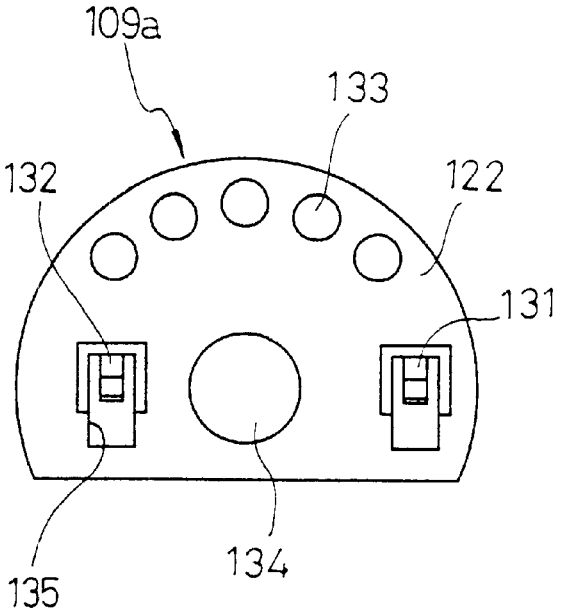

The clip spring electrodes 131 and 132 of the terminal plate 109*a,* if a flexible PCB 122 is used, can be made of by a press technique as shown FIGS. 7A to 7C. Also, the terminal plates 109 and 109*a* may be configured such that the hole 134 serving to allow the fixed coil 124 to be passed through therein and the vent hole 133 serving to allow for a flow of air are formed at the inner and outer sides of the PCB 115 and 122, respectively, as shown in FIGS. 4 to 7C. The terminal plates 109 and 109*a* and the fixed coil 124 may be integrally formed at a bottom side of the frame 102 using an insert injection molding method.

Further, for the purpose of coupling automatically the micro-speaker to a main PCB, the frame 102 has a protrusion structure 138 of a coupler 119 extending downwardly and bent outwardly from a circumferential end spaced apart from a center of the rear surface of the bottom portion of the frame 102, and the coupler 119 supported by a supporter 120 formed at the inner wall thereof is arranged vertically in a circular manner, and a stopper 118 serving to protect the electrodes 116 and 128, when assembling the micro-speaker of the present invention, is integrally formed at the edge of the bottom portion of the frame 102.

The PCB 126 where the speaker unit is mounted, has a mounting hole 137 formed thereon to allow for the mounting the speaker unit, a first circular electrode pattern 135 formed at the outer side of the mounting hole 127, and a second circular electrode pattern formed at the first circular electrode pattern 136.

Consequently, the mounting hole 137 corresponds to the coupler 119 , and the first and second circular electrode patterns 135 and 136 correspond to two electrodes 116 and 128 of the speaker separately, respectively.

According to the present invention, since the coupler 119 has a circular shape, it is possible to smoothly assemble the speaker to the frame although pressing it to the frame in all directions of 360 degrees. Further, the flexible electrodes 116 and 128, having a different circular locus, allow for automatic electrode connection in all directions of 360 degrees without using a soldering process.

Although in the above-mentioned embodiments, a micro-speaker in which an easy automatic mounting structure is integrally formed with a frame, has been described, the present invention is not limited to this, and it is possible to omit a coupler formed at the bottom portion of the frame for an automatic mounting of the speaker and an elastic spring electrode terminal and to employ a structure in which a pair of electrode terminals similar to the conventional case are coupled between output terminals of a set.

A basic idea of the present invention is based on an electric-acoustic transducing method and its structure in which an alternating magnetic field is generated in accordance with an electric driving signal from the outside in a state in which a driving coil is fixed to a frame, so that a permanent magnet, supported by a vibrating diaphragm, serving to generate non-alternating magnetic field is moved, which in turn, moves the vibrating diaphragm, thereby emitting a sound corresponding to the electric signal. This technical idea is also applicable to any kind of electric-acoustic transducer.

Further, of course, it is possible to separately apply only a structure allowing for an automatic mounting of the speaker in all directions of 360 degrees and an automatic electrode connection function, without having the moving magnet, to conventional other speakers.

In the above-mentioned embodiments of FIGS. 6A to FIG. 7C, a second electrode pattern and a second electrode are configured such that they are disposed spaced apart at an opposite position around a center of a coil hole of a terminal plate, but the second electrode pattern and the second electrode may be disposed at one side thereof the center of the coil hole.

Industrial Applicability

As apparent from the above description, the present invention provides a micro-speaker which has a high input receiving function, a wide band reproducing function and an automatic mounting method of the speaker in all directions of 360 degrees. That is, the speaker according to the present invention allows for performance of all functions of a micro-speaker, a receiver and a buzzer in a single unit, so that in the case of a variety of mobile communication terminals, each including the micro-speaker and the buzzer, it can be used as a single unit.

In addition, according to the present invention, only a simple feed and pressure applying process makes it possible to assemble a speaker set, which results in obviation of a conventional speaker fixing and electrode connection operation, and accomplishment of automation in operation. A great deal of effort and time is not needed when embedding or mounting the speaker in the PCB. Further, the speaker of the present invention allows for a wide band reproducing and a high input receiving, thereby leading to development of high-tech portable electronic appliances with a more improved sound reproducing ability While there have been illustrated and described what are considered to be preferred specific embodiments of the present invention, it will be understood by those skilled in the art that the present invention is not limited to the specific embodiments thereof, and various changes and modifications and equivalents may be substituted for elements thereof without departing from the true scope of the present invention.

What is claimed is:

1. An electric-acoustic transducer comprising:

at least one fixed coil adapted to generate an alternating magnetic field responsive to receiving an externally applied electrical drive signal;

a frame having a recessed structure for centrally receiving and supporting said fixed coil;

at least one disk-shaped moving permanent magnet disposed over said fixed coil while being spaced from said fixed coil by a predetermined vertical distance, said moving permanent magnet serving to generate a non-alternating magnetic field; and a vibrating diaphragm supported by an upper end of said frame at a peripheral portion thereof, said vibrating diaphragm securing said permanent magnet to a surface of a central portion thereof;

whereby said vibrating diaphragm vibrates vertically in accordance with an interaction between said alternating magnetic field generated from said fixed coil and said non-alternating magnetic field generated from said permanent magnet, thereby generating sound corresponding to the drive signal.

2. An electric-acoustic transducer comprising:

a single fixed coil adapted to generate an alternating magnetic field responsive to receiving an externally applied electrical drive signal;

a frame having a recessed structure for centrally receiving and supporting said fixed coil;

a single moving permanent magnet disposed over said fixed coil while being spaced from said fixed coil by a predetermined vertical distance, said moving permanent magnet serving to generate a non-alternating magnetic field, said moving permanent magnet having a centrally disposed through hole allowing said fixed coil to pass therethrough; and, a vibrating diaphragm supported by an upper end of said frame at a peripheral portion thereof, said vibrating diaphragm supporting said permanent magnet by a central portion thereof;

whereby said vibrating diaphragm vibrates vertically in accordance with an interaction between said alternating magnetic field generated from said fixed coil and said non-alternating magnetic field generated from said permanent magnet.

3. An electric-acoustic transducer comprising:

at least one fixed coil adapted to generate an alternating magnetic field responsive to receiving an externally applied electrical drive signal;

a frame having a recessed structure for centrally receiving and supporting said fixed coil;

at least one moving permanent magnet disposed over said fixed coil while being spaced from said fixed coil by a predetermined vertical distance, said moving permanent magnet serving to generate a non-alternating magnetic field; and a vibrating diaphragm supported by an upper end of said frame at a peripheral portion thereof, said vibrating diaphragm supporting said permanent magnet by a central portion thereof, said vibrating diaphragm being made of a non-magnetic material and having an annular edge fixed to said frame, said vibrating diaphragm having a body joined to said annular edge at a peripheral portion thereof and bonded to said permanent magnet at a lower surface thereof to integrally couple said permanent magnet to said body, said permanent magnet being centrally arranged with respect to said body;

whereby said vibrating diaphragm vibrates vertically in accordance with an interaction between said alternating magnetic field generated from said fixed coil and said non-alternating magnetic field generated from said permanent magnet.

4. An electric-acoustic transducer comprising:

at least one fixed coil adapted to generate an alternating magnetic field responsive to receiving an externally applied electrical drive signal;

a frame having a recessed structure for centrally receiving and supporting said fixed coil;

at least one moving permanent magnet disposed over said fixed coil while being spaced from said fixed coil by a predetermined vertical distance, said moving permanent magnet serving to generate a non-alternating magnetic field; and a vibrating diaphragm supported by an upper end of said frame at a peripheral portion thereof, said vibrating diaphragm supporting said permanent magnet by a central portion thereof;

magnetic flux concentration means for concentrating magnetic flux on a peripheral portion of said permanent magnet, said magnetic flux concentration means defining an air gap where an upper end of said fixed coil is arranged in an initial state, said magnetic flux being concentrated in said air gap, said magnetic flux concentration means including:

(a) an inverted U-shaped cylindrical yoke arranged between said permanent magnet and said vibrating diaphragm, said yoke having an annular skirt at a peripheral portion thereof; and (b) a disc-shaped plate fixed to a lower surface of said permanent magnet, said disc-shaped plate having a peripheral portion defining said air gap with said skirt of said yoke.

5. An electric-acoustic transducer comprising:

at least one fixed coil adapted to generate an alternating magnetic field responsive to receiving an externally applied electrical drive signal;

a frame having a recessed structure for centrally receiving and supporting said fixed coil;

at least one moving permanent magnet disposed over said fixed coil while being spaced from said fixed coil by a predetermined vertical distance, said moving permanent magnet serving to generate a non-alternating magnet field;

a vibrating diaphragm supported by an upper end of said frame at a peripheral portion thereof, said vibrating diaphragm supporting said permanent magnet by a central portion thereof, said vibrating diaphragm vibrates vertically in accordance with an interaction between said alternating magnetic field generated from said fixed coil and said non-alternating magnetic field generated from said permanent magnet;

a printed circuit board buried in a bottom portion of said frame, said printed circuit board having a pair of electrode patterns respectively connected to a pair of coil lines extending from said fixed coil, so that said printed circuit board serves as a terminal plate, said electrode patterns being arranged at different radial positions with respect to a central portion of said fixed coil;

a pair of electrodes each having one end mounted to an associated one of said electrode patterns and an opposing end elastically extending downwardly from said printed circuit board, said drive signal being applied to said electrodes; and snap coupling means extending downwardly from said bottom portion of said frame between said electrodes, said snap coupling means being coupled in a snapped fashion to a coupling hole formed in a main printed circuit board mounted to an appliance to which the transducer is applied, said main printed circuit board generating said drive signal and having a pair of concentric annular electrode pads arranged at different radial positions with respect to a center of said coupling hole, said radial positions of said annular electrode pads respectively corresponding to said radial positions of said electrodes;

whereby said electrodes are respectively connected to said electrode pads responsive to said snap coupling means being coupled to said coupling hole of said main printed circuit board.

6. The electric-acoustic transducer according to claim 5, wherein said snap coupling means comprises:

a cylindrical body provided with at least two vertical slits to have an elasticity;

an annular protrusion outwardly protruded in a radial direction from a tip of said cylindrical body;

support ribs extending inwardly from said cylindrical body; and a plurality of stoppers protruded downwardly from a peripheral portion of said frame and adapted to prevent said electrodes from being damaged when said snap coupling means is coupled to said coupling hole of said main printed circuit board.

7. An electric-acoustic transducer comprising:

at least one fixed coil adapted for receiving an externally applied electrical drive signal;

a frame having a recessed structure for centrally receiving and supporting said fixed coil;

one disk-shaped moving permanent magnet disposed over said fixed coil while being spaced from said fixed coil by a predetermined vertical distance to be vertically movable thereat; and a flexible mounting member having a annular edge fixed to an upper end of said frame and an inner peripheral surface portion adapted to support said permanent magnet;

whereby said permanent magnet vibrates vertically in accordance with an interaction between an alternating magnetic field generated by said fixed coil in response to said drive signal and a non-alternating magnetic field generated by said permanent magnet, thereby generating sound corresponding to said drive signal from said vibration of said permanent magnet.

8. An electric-acoustic transducing method comprising the steps of:

providing a fixed coil secured to a frame;

supporting a peripheral portion of a flexible member by the frame;

securing a disk-shaped moving permanent magnet to a surface of said flexible member a predetermined vertical distance above the fixed coil, said disk-shaped moving permanent magnet being adapted to generate a non-alternating magnetic field of a predetermined magnitude;

externally applying an electrical drive signal to said fixed coil to generate an alternating magnetic field varying in accordance with said electrical drive signal; and vibrating the disk-shaped moving permanent magnet vertically by the alternating magnetic field, thereby generating sound by vibration of the moving permanent magnet.

* * * * *